US006028946A

United States Patent [19]

Jahne

[11] Patent Number: 6,028,946

[45] **Date of Patent: *Feb. 22, 2000**

[54] MICROPHONE WITH ASSOCIATED AMPLIFIER

[75] Inventor: Helmut Jahne, Berlin, Germany

[73] Assignee: Stage Tec Entwicklungsgesellschaft für professionelle Audiotechnik mbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/629,979

[22] Filed: Apr. 9, 1996

[30] Foreign Application Priority Data

Feb. 6, 1996 [DE] Germany ..... 196 06 261

[51] Int. Cl.[7] ..... H04R 3/00

[52] U.S. Cl. ..... 381/122; 381/26; 381/113; 381/111

[58] Field of Search ..... 381/122, 26, 92, 381/27, 119, 17, 113, 174, 191, 111–115; 375/242

[56] References Cited

U.S. PATENT DOCUMENTS

| | | | |
|---|---|---|---|
| 4,414,433 | 11/1983 | Horie et al. | 381/92 |
| 4,491,697 | 1/1985 | Tanaka et al. | 381/113 |
| 4,757,545 | 7/1988 | Rosander | 381/92 |
| 4,817,153 | 3/1989 | Fernandez | 381/26 |
| 5,051,799 | 9/1991 | Paul et al. | 375/242 |
| 5,465,270 | 11/1995 | Beauducel et al. | 375/242 |

FOREIGN PATENT DOCUMENTS 2277840 11/1994 United Kingdom .

*Primary Examiner*—Paul Loomis
*Assistant Examiner*—Duc Nguyen
*Attorney, Agent, or Firm*—Londa and Traub LLP

[57] ABSTRACT

The problem addressed by the invention, to develop a microphone with associated amplifier which has a better dynamic response than analog microphones, requires less space, can replace analog microphones by using cables already in place, and has a low-cost construction, is solved by the invention in that the microphone is made up of an electroacoustic transducer, two analog-digital converters, two preamplifiers connected to the output of the electroacoustic transducers on the one hand and on the other hand each with preamplifiers connected each to an analog-digital converter, and with a driver stage connected to the analog-digital converters for a two-channel digital audio format and in that the amplifier is made up of a receiver for a two-channel digital audio format and a signal processor which generates a one-channel signal from the two-channel audio format as an image of the signal of the electroacoustic transducer. The field of application is in musical production. The invention is illustrated by FIGS. 1 and 2.

9 Claims, 1 Drawing Sheet

MICROPHONE WITH ASSOCIATED AMPLIFIER

The invention relates to a microphone with associated amplifier, these being of digital construction. The field of application of the invention lies in studio technology, and radio and television technology, as well as theatrical and musical production.

It is known that sound signals are increasingly being stored and processed digitally. This entails advantages in the quality and price of the apparatus used, in comparison to analog apparatus. However, it has not been possible heretofore to digitalize the signals of microphones in sufficient quality, since in contrast to telecommunication, for example, the available dynamics of the analog-digital converters are in some cases considerably poorer than the useful dynamics of analog microphones. It is therefore common practice to connect microphones with their often weak analog signals through long cables to controllable microphone amplifiers which are set by the sound engineer so that analog-digital converters then connected will be optimally modulated. The result is two large problems.

The first problem is that interference can easily be picked up by the cables between the microphone and the microphone amplifier, so that special routing rules have to be observed, especially when power lines or lighting control lines run parallel.

Second a great deal of experience is needed for the adjustment of the microphone amplifier in order on the one hand to leave sufficient reserve for the clipping limit of the analog-digital converter, and on the other hand to keep the quantization noise of the analog-digital converter sufficiently low with respect to the signal. An incorrect estimate can make an entire recording unusable.

An attempt to digitalize the signal of a microphone has already been made by a microphone manufacturer. In spite of using the best available analog-digital converter circuit the only dynamic response that was obtained was about 10 dB lower than that of the corresponding analog microphone. In microphones with a very great dynamic range an impairment of about 25 dB must be expected. An analog-digital converter has been proposed, and one has been disclosed in DE-OS 4420713 A1, that permits a substantially greater dynamic response, but is has not built so far. This analog-digital converter is based on a plurality of lower dynamic analog-digital converters fed by preamplifiers with different values of gain. Subsequently, one analog-digital converter is working with high resolution at low level input signals and another analog-digital converter is working with high resolution at high level input signals. For this purpose a signal processor is needed to eliminate all errors based on different signal paths.

The cables necessary for the operation of a digital microphone constitute an additional problem. In the experiment referred to above, three cables were used: one cable to carry the digital audio values, a second cable to carry a sampling cycle to the microphone, and a third cable for power supply. The sampling cycle is necessary for the synchronous sampling of the audio levels by the other connected digital processing apparatus. Operating the microphone as a sampling source with a fixed crystal oscillator is not possible, since the connection of several microphones must be possible and therefore the connected apparatus cannot be synchronized with the microphone. The separate power supply cable is necessary due to the required power of about 0.5 to 1 watt. For the microphone user, a plurality of microphone cables represents a big problem, since in changing over from analog to digital technology, not only must the microphone and the corresponding amplifiers be replaced, but also the installations in the different housings. In addition, another kind of spare cables is necessary, and compatibility or quick changeover is impossible. Modulating the necessary signals onto the digital audio cable, which may be plug-compatible with the analog audio cable, founders on the high cost and the amount of space required for the purpose in the microphone. Just the expense of obtaining the low-jitter sampling cycle, which with a PLL is additionally increased to a multiple of the sampling cycle in order to drive the analog-digital converter, represents a great technical problem in view of the great number of standardized sampling frequencies.

A theoretical possibility for eliminating the sampling cable is the use of so-called sampling rate converters which can be connected between the microphone and the associated amplifier. At the present time such sampling rate converters have less usable dynamic range than available analog-digital converter circuits, so that this would lead to a further degradation of the qualities of a digital microphone.

The problem to which the invention is addressed is the development of a microphone with associated amplifier in digital technology, in which the dynamic range of the microphone is not limited by the analog-digital converter, in which operation with the microphone cables of an analog microphone will be possible, and in which the cost involved and space requirements are low.

This problem of developing a microphone with corresponding amplifier offering a better dynamic range than analog microphones, occupying less space, interchangeable with analog microphones using available cables, and involving less costly construction, is solved by the invention in that the microphone and the associated amplifier have digital circuits which are interconnected by a shielded symmetrical cable, while the circuit for the microphone contains a sound converter, two preamplifiers, two analog-digital converters and a driver stage for a two-of channel digital audio format, the preamplifiers being connected to the output of the sound converter and connected each with an analog-digital converter, the analog-digital converters being connected to the digital driver stage, and the associated amplifier containing a receiver for a two-channel digital audio format and a signal processor which generates from the two-channel digital format a single-channel signal which represents an image of the signal of the sound converter, and which is used for computing the amplification and filtering commonly used in microphones.

An advantageous embodiment of the microphone additionally has a switch and a calibration oscillator which are wired such that the sound converter is alternately connected with the two preamplifiers or the calibration oscillator is connected to the two preamplifiers. The switch independently cuts off the calibration oscillator by remote control a given time after the microphone is turned on and connects the sound converter to the preamplifiers, the given time being made such that the signal processor can determine the coefficients which effect on differences of different signals and are are necessary for generating the single-channel signal from the two-channel digital audio format.

In an additional embodiment of the invention, an identification code can be entered via the microphone into the two-channel digital audio format to indicate the position of the switch, causing a muting in the associated digital amplifier of the signal of the balancing oscillator by means of the signal processor.

To avoid synchronization problems or problems with the external sampling connection, the microphone can have its own audio sampling oscillator. The necessary sampling synchronization by means of a two-channel sampling rate converter is performed in the associated digital amplifier which is arranged between the receiver of the digital audio format and the signal processor.

The two-channel digital audio format advantageously complies with the AES/EBU standard which permits the transmission of digital audio information via cable and plug connector which are used for the transmission of analog microphone signals.

The average differential AES/EBU signal can have a voltage with respect to the shielding, which will serve for supplying power to the digital microphone without additional cables.

In the associated amplifier, pulses can be modulated onto the voltage of the power supply of the microphone which serve for the remote control of microphone settings.

BRIEF DESCRIPTION OF THE DRAWING

The object of developing a microphone with allocated amplifier, which has better dynamics than the analog microphone, is furthermore accomplished owing to the fact that, between two analog-digital converters and the digital driver stage, an additional signal processor is connected, which assumes a portion of the tasks of the signal processor of the allocated amplifier and moreover generates from the 2-channel digital audio format, a 1-channel digital audio format, which represents an image of the signal of the sound converter. For this microphone with allocated amplifier, a digital amplifier is inserted between the receiver for a digital audio format and the 2-channel scanning rate converter. This digital amplifier generates an additional, amplified signal from the 1-channel, digital audio format, as a result of which the 2-channel, sampling rate converter is energized, on the one hand, with the 1-channel audio signal and, on the other, with the additional, amplified signal.

The invention is to be explained hereinbelow by an example of its embodiment. In the drawings.

DETAILED DESCRIPTION

Figure 1:
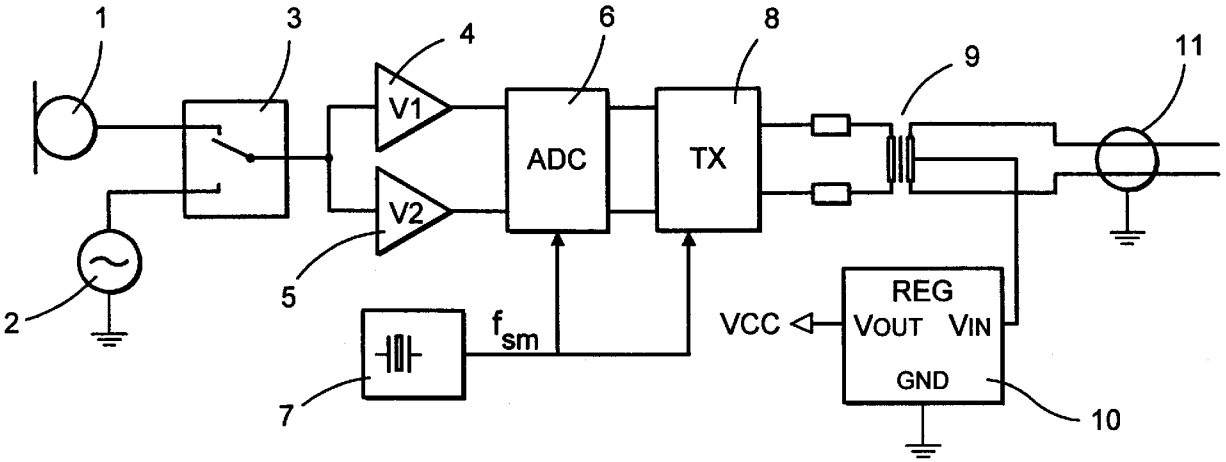
FIG. 1 shows a circuit of a digital microphone constructed according to the invention, and FIG. 2 a circuit of an associated digital amplifier.
Figure 2:
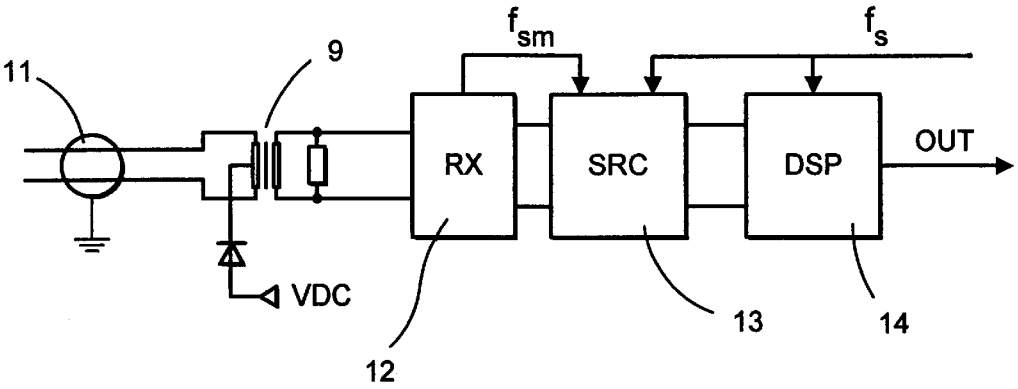

The microphone is connected to an associated amplifier through a shielded symmetrical cable. In the microphone there is contained the electroacoustic transducer 1, a condenser microphone cartridge and its impedance converter which is connected to the switch 3. After the microphone is turned on the switch 3 can present, instead of the transducer signal, the signal from an equalization oscillator 2 through the transmission chain to the signal processor 14 to obtain starting values of an iterative computation. The signal from switch 3 is fed to the two different preamplifiers 4 and 5 which in turn control each one channel of the two-channel ADC 6. The ADC 6 transfers the two digitalized audio values to the transmitter component 8 which gives a two-channel digital sound signal in coded form to a symmetrical two-wire conductor, in accord with the published AES/EBU standard. Both the ADC 6 and the AES/EBU transmitter are supplied with the sampling cycle $f_{SM}$ of a quartz oscillator, the sampling cycle oscillator 7. The AES/EBU standard provides for the use of pulse transmitters both on the transmission and on the receiving end in professional applications. These pulse transformers 9 are here additionally provided with a center tap for the power supply. In the microphone the center tap of the pulse transformer 9 is connected to the input of the voltage regulator 10 which in turn supplies the entire microphone with the necessary voltage VCC.

The shielded symmetrical cable 11 can be connected to the pulse transformer 9 by the XLR plug connections common in studio technology.

The shielded symmetrical cable 11, which comes from the microphone, is connected in the microphone amplifier to the pulse transformer 9. The center tap of the pulse transmitter 9 is connected through a decoupling diode to the power supply VDC. The decoupling diode permits the use of a plurality of microphone amplifiers on one microphone. The side of the pulse transformer 9 remote from the cable 11 is connected to the inputs of an AES/EBU receiver component 12 which decodes the two digital audio signals and recovers the sampling cycle $f_{SM}$ used in the microphone. By means of the recovered sampling cycle $f_{SM}$ and the microphone amplifier sampling $f_S$, which is identical with the sampling of all other digital processing apparatus, the sampling rate converter 13 can convert the two digital audio signals of the AES/EBU receiver 12 into digital audio signals which are synchronous with the sampling rate $f_S$. The converted digital audio signals are applied to the input of the signal processor 14 which computes the single-channel digital audio signal that corresponds to that of the electroacoustic transducer, sampled with the sampling frequency $f_S$. The signal processor 14 furthermore continues to perform microphone signal amplification and filtration the same as it does in analog microphone amplifiers.

The use of the invention provides not only an improvement of the quality of transmission but also the advantage that a digital microphone can be operated with the microphone cables of an analog microphone. Also, the cost of the construction of the digital microphone configured according to the invention, as well as the space it requires, are low, so that analog microphones can be replaced by digital microphones in a simple manner.

In a further development of the invention, the 2-channel audio format is converted still in the microphone into a 1-channel audio signal with the help of an additional signal processor. As a result, when standardized, 2-channel, digital audio driver and receiver circuits are used, on the one hand, a transmission, conforming to standards, becomes possible and, on the other, an otherwise usable second transmission channel arises. The 1-channel, digital audio format must, however be split once again by a digital amplifier in the amplifier allocated to the microphone, in order to solve problems of the scanning rate conversion.

The advantage of this variation of the solution lies therein that a transmission, conforming to standards, takes place with the 1-channel technique.

I claim:

1. A microphone with an associated amplifier, wherein the microphone and the associated amplifier have each a digital circuit connected together by cables such that the circuit for the microphone contains an electroacoustic transducer, two preamplifiers which differ in value of gain, two analog-digital converters and a driver stage for a two-channel digital audio format, the preamplifiers being connected to the output of the electroacoustic transducer and being connected in turn each with an analog-digital converter, and the analog-digital converters being connected to the digital driver stage, the associated amplifier containing a receiver for a two-channel digital audio format and a signal processor which determines coefficients for generating, from the two-channel digital audio format, a single-channel signal which is an image of the signal of the electroacoustic transducer, whereby amplification and filtration are thereby computed.

2. The microphone and associated amplifier according to claim 1, wherein the circuit of the microphone additionally has a switch and a calibration oscillator, which are connected such that the electroacoustic transducer is alternatively connected to the two preamplifiers or the calibration oscillator is connected to the two preamplifiers, the switch cutting off the calibration oscillator automatically at a preset time after the microphone is turned on, or by remote control, and connecting the electroacoustic transducer to the preamplifiers, and the preset time being such that the signal processor is able to determine the coefficients of both preamplifiers which are necessary for the generation of the single-channel signal from the two-channel digital audio format.

3. The microphone and associated amplifier according to claim 2, wherein, in the circuit of the microphone, an identification code is put into the two-channel digital audio format which indicates the position of the switch, whereby a muting of the signal of the calibration oscillator is performed in the associated amplifier by means of the signal processor.

4. The microphone and associated amplifier according to claim 1, wherein the circuit of the microphone has its own audio sampling cycle oscillator and the necessary sampling cycle synchronization is performed by means of a two-channel sampling rate converter which is disposed in the associated amplifier between the receiver of the digital audio format and the signal processor.

5. The microphone and associated amplifier according to claim 1, wherein the two-channel digital audio format complies with the AES/EBU standard which permits the transmission of digital audio information via cable and plug which are used for the transmission of analog microphone signals.

6. The microphone and associated amplifier according to claim 5, wherein the average of the differential AES/EBU signal has a voltage with respect to the shielding which serves to supply power to the microphone without additional cables.

7. The microphone and associated amplifier according to claim 6, wherein, in the associated amplifier, pulses are modulated onto the voltage of the microphone power supply, which serve for the remote control of microphone settings.

8. The microphone and associated amplifier according to claim 4, wherein an additional signal processor is inserted between the analog-digital converters and the digital drive stage, generating from the two-channel digital audio format a single-channel signal.

9. The microphone and associated amplifier according to claim 8, wherein a digital amplifier is inserted between the receiver for digital audio format and the two-channel sampling rate converter, generating from the output signal of the receiver an additional amplifier signal, so that one input of the sampling rate converter is directly fed with the output signal from the receiver while the other input is fed with the amplified signal from the inserted digital amplifier.

* * * * *